US011649656B2

(12) United States Patent
Yeo et al.

(10) Patent No.: US 11,649,656 B2
(45) Date of Patent: May 16, 2023

(54) SMART DEADLOCK SYSTEM

(71) Applicant: DONGSUNG INDUSTRY CO., LTD, Daegu (KR)

(72) Inventors: Joo Hee Yeo, Daegu (KR); Kyoung Hwan Jung, Daegu (KR)

(73) Assignee: DONGSUNG INDUSTRY CO., LTD, Daegu (KR)

( * ) Notice: Subject to any disclaimer, the term of this patent is extended or adjusted under 35 U.S.C. 154(b) by 263 days.

(21) Appl. No.: 17/094,126

(22) Filed: Nov. 10, 2020

(65) Prior Publication Data

US 2021/0262252 A1 Aug. 26, 2021

(30) Foreign Application Priority Data

Feb. 20, 2020 (KR) ..... 10-2020-0020868
Oct. 28, 2020 (KR) ..... 10-2020-0141136

(51) Int. Cl.
*E05B 47/06* (2006.01)
*E05B 47/00* (2006.01)

(52) U.S. Cl.
CPC .. *E05B 47/0603* (2013.01); *E05B 2047/0053* (2013.01); *E05B 2047/0095* (2013.01)

(58) Field of Classification Search
CPC ..... E05B 47/00; E05B 47/06; E05B 47/0603; E05B 47/0607; E05B 2047/0048; E05B 2047/005; E05B 2047/0051; E05B 2047/0052; E05B 2047/0054;
(Continued)

(56) References Cited

U.S. PATENT DOCUMENTS 4,901,545 A * 2/1990 Bacon ..... E05B 47/0653 70/285
2015/0247345 A1* 9/2015 Carpenter ..... E05B 65/1053 70/277
2018/0298640 A1* 10/2018 Caterino ..... E05B 15/02

FOREIGN PATENT DOCUMENTS

KR 20-2011-0010309 U 11/2011
KR 20-2013-0006122 U 10/2013
(Continued)

OTHER PUBLICATIONS

Office action dated Sep. 26, 2021 from Korean Patent Office in a counterpart Korean Patent Application No. 10-2020-0141136 (all the cited references are listed in this IDS.) (English translation is also submitted herewith.).

*Primary Examiner* — Nathan Gumar
(74) *Attorney, Agent, or Firm* — The PL Law Group, PLLC

(57) ABSTRACT

A smart deadlock system according to an embodiment of the present invention includes a thumb-turn, a key cylinder, a connecting shaft connecting the thumb-turn and the key cylinder, and a sensor module. The sensor module may include a sensing unit to sense a rotation state of a rotation sensing element inserted onto the connecting shaft, and generate sensing information associated with the rotation state of the rotation sensing element, and a rotation information generation unit to receive the sensing information from the sensing unit, and generate rotation information associated with an extent of rotation of the rotation sensing element based on the sensing information. According to the smart deadlock system, it is possible to check the operation of the deadlock more accurately by sensing the rotation state of the rotation sensing element using the sensor.

9 Claims, 8 Drawing Sheets

(58) Field of Classification Search
CPC ..... E05B 2047/0053; E05B 2047/0094; E05B 2047/0095
USPC ..... 70/277
See application file for complete search history.

(56) References Cited

FOREIGN PATENT DOCUMENTS

| | | | |
|---|---|---|---|
| KR | 10-1329600 | B1 | 11/2013 |
| KR | 10-1470747 | B1 | 12/2014 |

* cited by examiner (a)

(b)

(a)

(b)

(a)

(b)

(a)

(b)

SMART DEADLOCK SYSTEM

CROSS-REFERENCE TO RELATED APPLICATIONS

This application claims the benefit under 35 USC § 119(a) of Korean Patent Application Nos. 10-2020-0020868 filed on Feb. 20, 2020 and 10-2020-0141136 filed on Oct. 28, 2020, in the Korean Intellectual Property Office, the entire disclosure of which is incorporated herein by reference for all purposes.

TECHNICAL FIELD

The present disclosure relates to a deadlock system.

BACKGROUND

In general, a doorlock is installed in a door, and after the doorlock is unlocked, a lever installed on the outside of the door is pulled to open the door.

The doorlock installed in the door includes a lock function in itself. Generally, the doorlock extends outward from the door, and may be susceptible to external impacts such as forces according to the shape or size.

To prevent this situation, most of doorlocks further include deadlocks exclusively having a lock function. The deadlock is designed to open the door by turning a thumb-turn from the inside of the door and using a key from the outside of the door.

In the same way as the doorlock, the deadlock is an opening/closing mechanism using a key. Accordingly, unless an external mechanical force is used, it is impossible to open the closed door without the key. Additionally, since the key is difficult to copy, unless the key is lost, the door is kept in closed state.

When only the manual opening/closing mechanism is used, there is inconvenience of having to always possess the key, and when the key is lost, there is inconvenience of making a new key that matches the deadlock or breaking the door. Additionally, in case of emergency such as fires, it is difficult to cope with such situations quickly, and thus there is a risk that damage will increase.

Accordingly, it is necessary to develop a deadlock with security by maintaining the mechanical opening/closing of the door using the key and enhanced convenience by applying automatic opening/closing using information and communications technology (ICT) such as smartphones.

SUMMARY

The present disclosure is directed to providing a smart deadlock system with high security and convenience together by simultaneously applying mechanical manual opening/closing that deadlocks originally have, and automatic opening/closing using an electrical signal.

The present disclosure is further directed to providing a smart deadlock system in which a communication device for communication with a smartphone, or a sensor for sensing external situations such as vibration/fire is mounted inside to make use of information and communications technology (ICT), thereby automatically opening and closing the door from the outside, and coping with emergency situations quickly.

The present disclosure is further directed to providing a smart deadlock system configured to disable automatic opening/closing when a user is at home, thereby improving security, and provide enhanced convenience through selection of manual and automatic opening/closing.

To achieve the above-described objects, there is provided a smart deadlock system including a thumb-turn, a key cylinder, and a connecting shaft connecting the thumb-turn and the key cylinder, the smart deadlock system including a sensor module including a sensing unit to sense a rotation state of a rotation sensing element inserted onto the connecting shaft, and generate sensing information associated with the rotation state of the rotation sensing element; and a rotation information generation unit to receive the sensing information from the sensing unit, and generate rotation information associated with an extent of rotation of the rotation sensing element based on the sensing information.

In addition, there is provided a smart deadlock system including a thumb-turn, a key cylinder, a connecting shaft connecting the thumb-turn and the key cylinder, and a sensor module to sense a motion of the connecting shaft, the smart deadlock system including a comparison module including a comparison unit to receive motion information of the connecting shaft from the sensor module in a sequential order and compare previous motion information with current motion information, and a change information generation unit to generate change information of the motion information; and a control module to receive the change information generated by the comparison module and control a storage location of the change information.

The smart deadlock system of the present disclosure can check the operation of the deadlock more accurately by sensing the rotation state of the rotation sensing element using the sensor.

Additionally, it is possible to provide high security and convenience together by simultaneously applying mechanical manual opening/closing that deadlocks originally have, and automatic opening/closing using an electrical signal.

Additionally, it is possible to automatically open and close the door from the outside and cope with emergency situations quickly by mounting inside a communication device for communication with a mobile terminal or a sensor for sensing external situations such as vibration/fire to make use of ICT.

Additionally, it is configured to disable automatic opening/closing when a user is at home, thereby improving security, and it is possible to enhance convenience through selection of manual and automatic opening/closing.

DETAILED DESCRIPTION OF EMBODIMENTS

Figure 1:
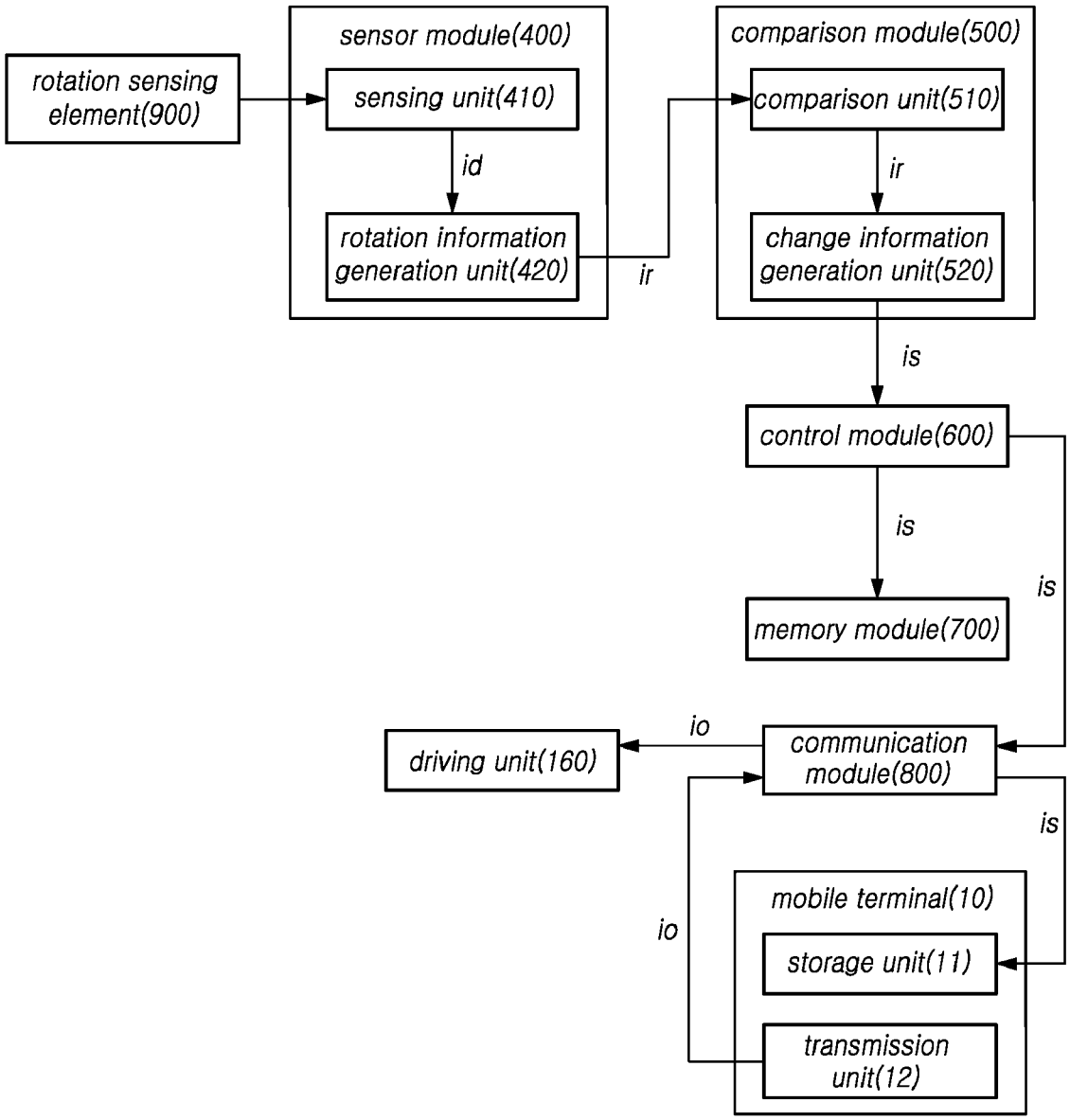
FIG. 1 is a block diagram of a smart deadlock system according to an embodiment of the present disclosure.

Exemplary embodiments of the present disclosure are described with reference to the accompanying drawings to provide the full and complete understanding of the present disclosure. The embodiments of the present disclosure may be modified in many forms, and the scope of the present disclosure should not be interpreted as being limited to the embodiments described in detail below. These embodiments are provided to fully explain the present disclosure to those skilled in the art. Accordingly, the shape of the elements in the drawings may be exaggerated for clarity of description. It should be noted that like reference signs denote like elements in each drawing. Additionally, a detailed description of known functions and elements that are determined to make the subject matter of the present disclosure unnecessarily ambiguous is omitted herein.

Hereinafter, the embodiments of the present disclosure will be described with reference to the accompanying drawings.

Figure 2:
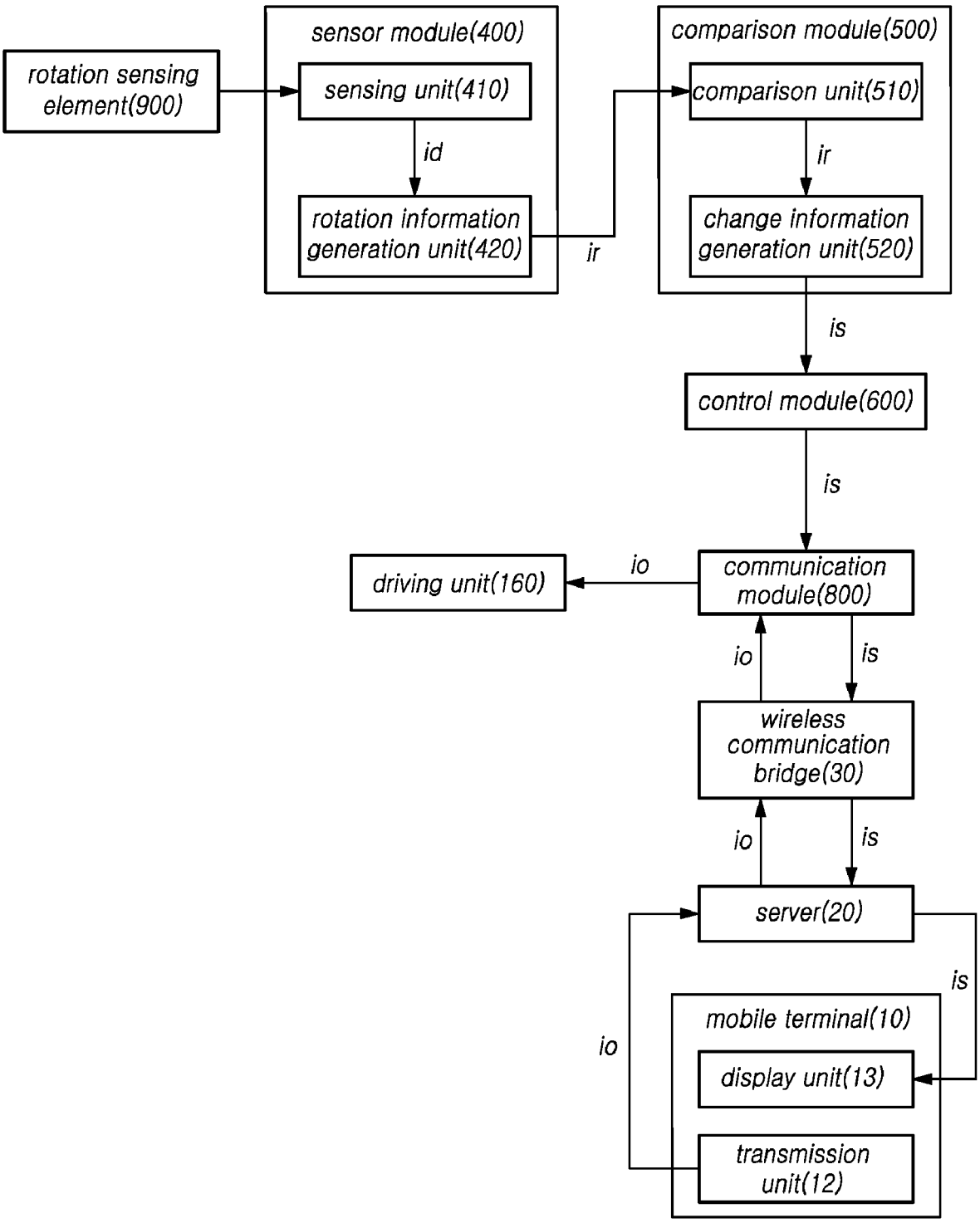
FIG. 2 is a block diagram of a smart deadlock system according to another embodiment of the present disclosure.
Figure 3:
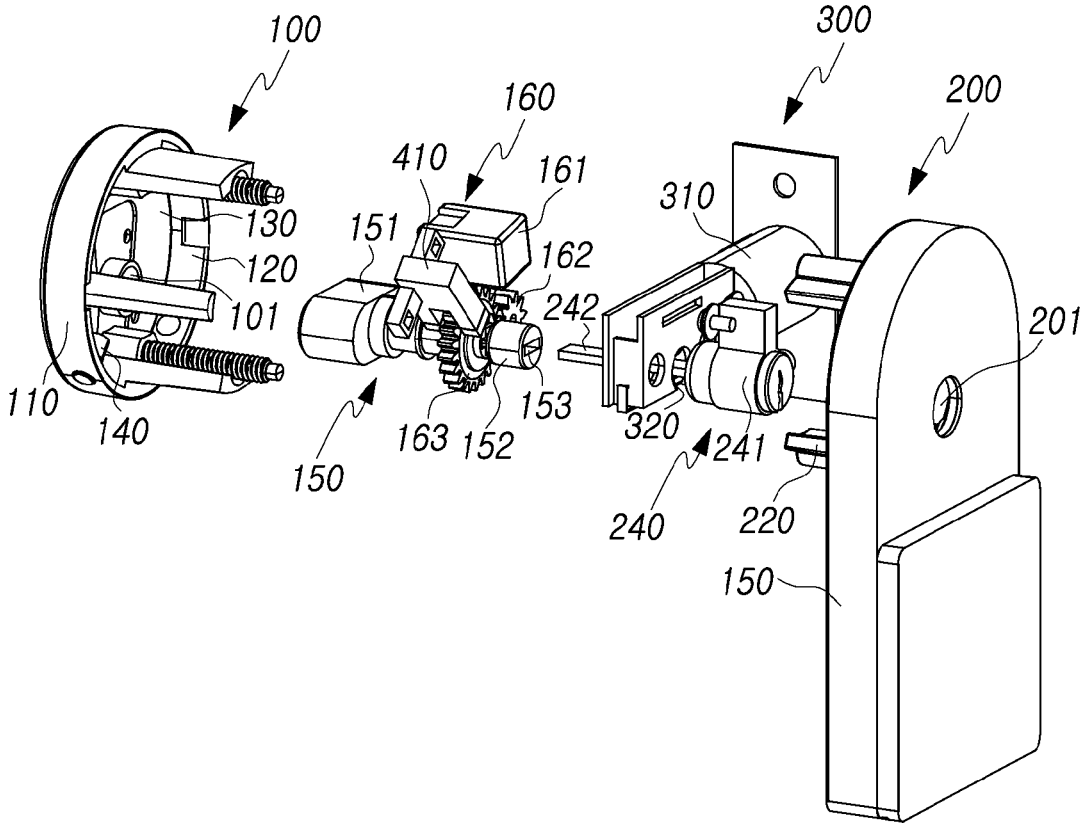
FIG. 3 is a partial exploded perspective view of the hardware structure of a smart deadlock system applicable to embodiments of the present disclosure.
Figure 4:
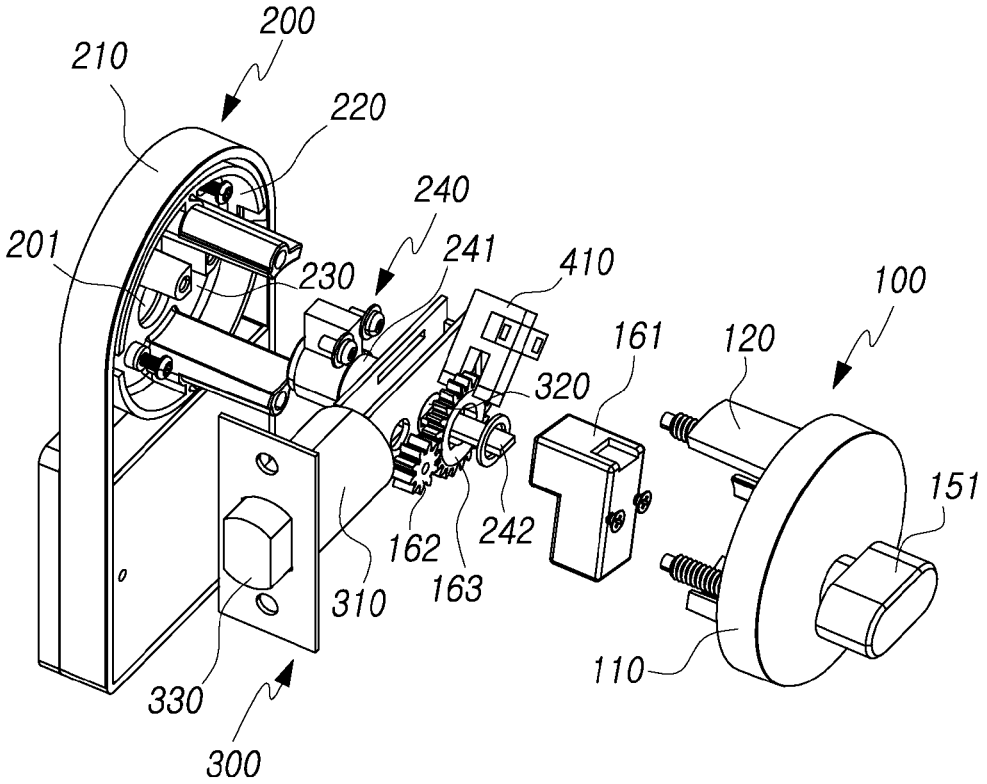
FIG. 4 is a partial exploded perspective view when viewed in the opposite direction to FIG. 3.
Figure 5:
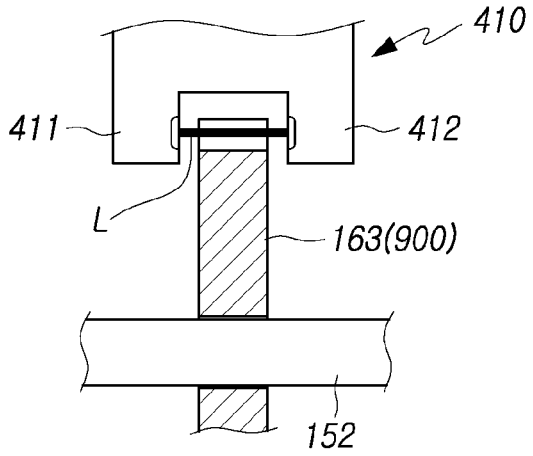
FIG. 5 is a diagram showing that a receiving unit receives a light source of a generation unit when a rotation sensing element of the present disclosure is provided as a driving gear.
Figure 5:
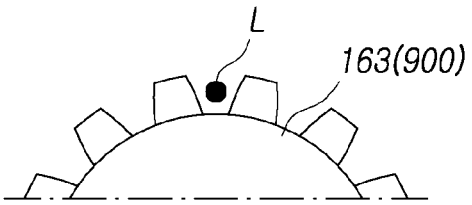
Figure 6:
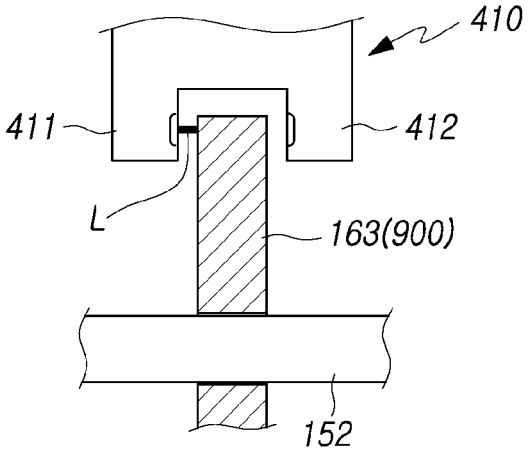
FIG. 6 is a diagram showing that a receiving unit does not receive a light source of a generation unit when a rotation sensing element of the present disclosure is provided as a driving gear.
Figure 6:
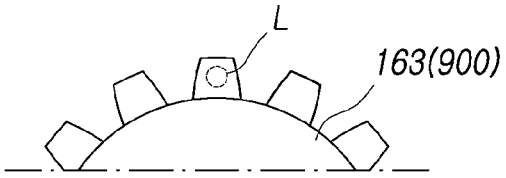
Figure 7:
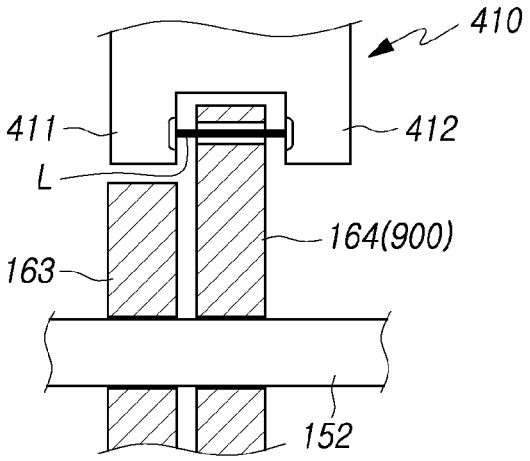
FIG. 7 is a diagram showing that a receiving unit receives a light source of a generation unit when a rotation sensing element of the present disclosure is provided as a sensing rotary plate.
Figure 7:
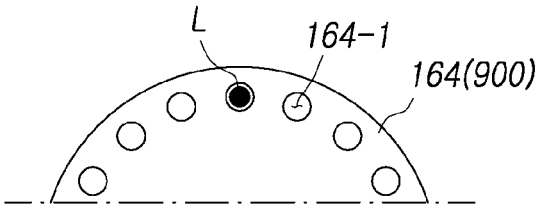
Figure 8:
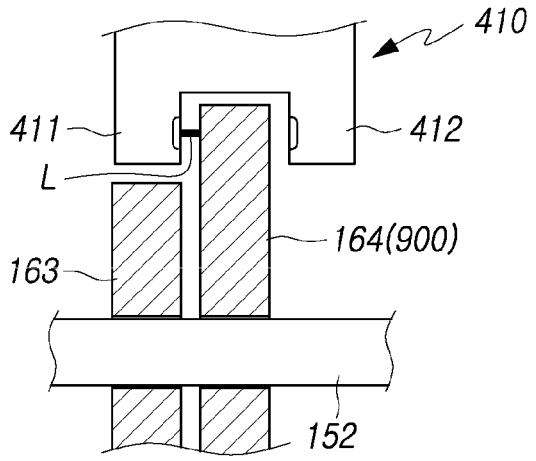
FIG. 8 is a diagram showing that a receiving unit does not receive a light source of a generation unit when a rotation sensing element of the present disclosure is provided as a sensing rotary plate.
Figure 8:
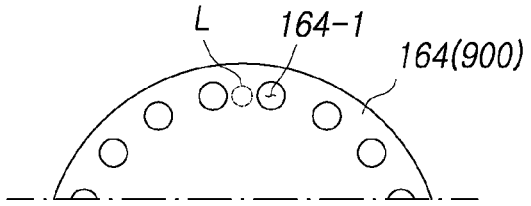

FIG. 1 is a block diagram of a smart deadlock system according to an embodiment of the present disclosure. FIG. 2 is a block diagram of a smart deadlock system according to another embodiment of the present disclosure. FIG. 3 is a partial exploded perspective view of the hardware structure of the smart deadlock system applicable to the embodiments of the present disclosure. FIG. 4 is a partial exploded perspective view when viewed in the opposite direction to FIG. 3. FIG. 5 is a diagram showing that a receiving unit receives a light source of a generation unit when a rotation sensing element of the present disclosure is provided as a driving gear. FIG. 6 is a diagram showing that the receiving unit does not receive the light source of the generation unit when the rotation sensing element of the present disclosure is provided as a driving gear. FIG. 7 is a diagram showing that the receiving unit receives the light source of the generation unit when the rotation sensing element of the present disclosure is provided as a sensing rotary plate. FIG. 8 is a diagram showing that the receiving unit does not receive the light source of the generation unit when the rotation sensing element of the present disclosure is provided as a sensing rotary plate.

As shown in the drawings, the smart deadlock system according to an embodiment of the present disclosure including a thumb-turn 151, a key cylinder 241 and a connecting shaft 152 connecting the thumb-turn 151 and the key cylinder 241 includes a sensor module 400 including a sensing unit 410 to sense the rotation state of a rotation sensing element 900 inserted onto the connecting shaft 152 and generate sensing information (id) associated with the rotation state of the rotation sensing element 900; and a rotation information generation unit 420 to receive the sensing information (id) from the sensing unit 410 and generate rotation information (ir) associated with the extent of rotation of the rotation sensing element 900 based on the sensing information (id).

Hereinafter, each element of the present disclosure will be descried in detail with reference to FIGS. 1 to 8.

The smart deadlock system according to an embodiment of the present disclosure is a smart deadlock system including a thumb-turn 151, a key cylinder 241 and a connecting shaft 152 connecting the thumb-turn 151 and the key cylinder 241, and in particular, the smart deadlock system includes a sensor module 400 to sense the extent of rotation of a rotation sensing element 900 by sensing the rotation state of the rotation sensing element 900 inserted onto the connecting shaft 152.

Here, the sensor module 400 may include a sensing unit 410 to generate sensing information (id) associated with the rotation state of the rotation sensing element 900; and a rotation information generation unit 420 to generate rotation information (ir) associated with the extent of rotation of the rotation sensing element 900 based on the sensing information (id).

First, the sensing unit 410 senses the rotation state of the rotation sensing element 900 inserted onto the connecting shaft 152, and generates sensing information (id) associated with the rotation state of the rotation sensing element 900.

The rotation sensing element 900 is inserted onto the connecting shaft 152 and rotates with the connecting shaft 152, and accordingly the rotation state of the rotation sensing element 900 may be sensed by the sensing unit 410 to sense a motion (the extent of rotation) of the connecting shaft 152.

Here, referring to FIGS. 3 and 5, the sensing unit 410 includes a generation unit 411 disposed on one side of the rotation sensing element 900 to generate a predetermined light source L toward the rotation sensing element 900; and a receiving unit 412 disposed on the other side of the rotation sensing element 900 to receive the light source L passing through the rotation sensing element 900.

First, the generation unit 411 is disposed on one side of the rotation sensing element 900 inserted onto the connecting shaft 152 to generate a predetermined light source L toward the rotation sensing element 900.

In more detail, the generation unit 411 may be disposed at the outside spaced a predetermined distance apart from the center of the connecting shaft 152 onto which the rotation sensing element 900 is inserted.

The light source L generated by the generation unit 411 may be, for example, a laser beam, but is not limited thereto, and all types of light sources that can arrive at the receiving unit 412 as described below through the rotation sensing element 900 may be the light source L generated by the generation unit 411.

Subsequently, the receiving unit 412 is disposed on the other side of the rotation sensing element 900 to receive the light source L passing through the rotation sensing element 900.

In more detail, the receiving unit 412 may be disposed at the outside spaced a predetermined distance apart from the center of the connecting shaft 152 onto which the rotation sensing element 900 is inserted, and the receiving unit 412 may be disposed opposing the generation unit 411 to receive the light source L passing through the rotation sensing element 900.

Here, the sensing unit 410 according to an embodiment of the present disclosure senses the rotation state of the rotation sensing element 900 depending on whether or not the receiving unit 412 receives the light source L, and generates the sensing information (id) according to the sensing result.

Accordingly, the sensing information (id) may include information about the receiving unit 412 having received the light source L and information about the receiving unit 412 having not received the light source L.

For example, as shown in FIGS. 5 and 6, the rotation sensing element 900 may be provided as a driving gear 163 having a plurality of teeth extending along the outer periphery, spaced apart at a predetermined interval, and in this instance, the light source L generated by the generation unit 411 may or may not be received by the receiving unit 412 through the outer part of the driving gear 163 depending on the rotation state of the driving gear 163.

In more detail, when the rotation state of the driving gear 163 inserted onto the connecting shaft 152 is formed as shown in FIG. 5, the light source L generated by the generation unit 411 may be received by the receiving unit 412 through the teeth of the gear.

On the contrary, when the rotation state of the driving gear 163 inserted onto the connecting shaft 152 is formed as shown in FIG. 6, the light source L generated by the generation unit 411 is blocked by the teeth of the gear and cannot be received by the receiving unit 412.

Accordingly, the sensing unit 410 may generate, as the sensing information (id), information about the receiving unit 412 having received the light source L or information about the receiving unit 412 having not received the light source L.

Meanwhile, as shown in FIGS. 7 and 8, the rotation sensing element 900 may be provided as a rotation sensing plate 164 having a plurality of light source passage holes 164-1 along the outer peripheral direction, spaced a predetermined interval apart from each other, and in this instance, the light source L generated by the generation unit 411 may or may not be received by the receiving unit 412 through the light source passage holes 164-1 of the rotation sensing plate 164 depending on the rotation state of the rotation sensing plate 164.

In more detail, when the rotation state of the rotation sensing plate 164 inserted onto the connecting shaft 152 is formed as shown in FIG. 7, the light source L generated by the generation unit 411 may be received by the receiving unit 412 through the light source passage holes 164-1 of the rotation sensing plate 164.

On the contrary, when the rotation state of the rotation sensing plate 164 inserted onto the connecting shaft 152 is formed as shown in FIG. 8, the light source L generated by the generation unit 411 is blocked by the outer part of the rotation sensing plate 164 and cannot be received by the receiving unit 412.

When the rotation sensing element 900 is provided as the rotation sensing plate 164, it is possible to prevent a phenomenon in which the rotation state of the driving gear 163 is incorrectly sensed by the wear of the teeth of the driving gear 163.

According to the foregoing, the sensing unit 410 may generate, as the sensing information (id), information about the receiving unit 412 having received the light source L or information about the receiving unit 412 having not received the light source L.

Meanwhile, the sensing unit 410 generates the sensing information (id) and transmits the sensing information (id) to the rotation information generation unit 420 of the sensor module 400.

The rotation information generation unit 420 receives the sensing information (id) from the sensing unit 410, and generates rotation information (ir) associated with the extent of rotation of the rotation sensing element 900 based on the sensing information (id).

As described above, the sensing information (id) may be information about the receiving unit 412 having received the light source L or information about the receiving unit 412 having not received the light source L, and accordingly the rotation information generation unit 420 may receive the information about the receiving unit 412 having received the light source L or the information about the receiving unit 412 having not received the light source L from the sensing unit 410.

The rotation information generation unit 420 generates the rotation information (ir) associated with the extent of rotation of the rotation sensing element 900 based on the sensing information (id) received from the sensing unit 410.

For example, the rotation information generation unit 420 may generate the rotation information (ir) associated with the extent of rotation of the rotation sensing element 900 according to the number of times in which the information about the receiving unit 412 having received the light source L and the information about the receiving unit 412 having not receive the light source L was received in an alternating manner.

According to the foregoing, when the rotation sensing element 900 rotates, the sensing unit 410 sequentially forms the information about the receiving unit 412 having received the light source L and the information about the receiving unit 412 having not received the light source L in an alternating manner, and thus may sense the extent of rotation of the rotation sensing element 900 according to the number of times in which the information about the receiving unit 412 having received the light source L and the information about the receiving unit 412 having not received the light source L was generated in an alternating manner.

It is because the greater extent of rotation of the rotation sensing element 900, the larger number of times in which the information about the receiving unit 412 having received the light source L and the information about the receiving unit 412 having not received the light source L was generated in an alternating manner.

As such, the rotation information generation unit 420 may receive the sensing information (id) from the sensing unit 410, generate the rotation information (ir), and sense the motion (the extent of rotation) of the connecting shaft 152 onto which the rotation sensing element 900 is inserted, from the finally generated rotation information (ir).

Subsequently, the smart deadlock system according to an embodiment of the present disclosure including the thumb-turn 151, the key cylinder 241, the connecting shaft 152 connecting the thumb-turn 151 and the key cylinder 241 and the sensor module 400 to sense the motion of the connecting shaft 152 may include a comparison module 500 including a comparison unit 510 to receive motion information of the connecting shaft 152 from the sensor module 400 in a sequential order and compare the previous motion information with the current motion information, and a change information generation unit 520 to generate change information (is) of the motion information; and a control module 600 to receive the change information (is) generated by the comparison module 500 and control the storage location of the change information (is).

Here, the sensor module 400 may be provided as the above-described sensor module 400, and accordingly a detailed description of the sensor module 400 is omitted herein.

The comparison module 500 includes the comparison unit 510 to receive the motion information of the connecting shaft 152 from the sensor module 400 in a sequential order and compare the previous motion information with the current motion information, and the change information generation unit 520 to generate the change information (is) of the motion information.

First, the comparison unit 510 receives the motion information of the connecting shaft 152 from the sensor module 400 in a sequential order, and compares the previous motion information with the current motion information.

According to the foregoing, the motion (rotation information) of the connecting shaft 152 onto which the rotation sensing element 900 is inserted may be sensed from the rotation information (ir) generated by the rotation information generation unit 420, and thus the motion information of the connecting shaft 152 may be the above-described rotation information (ir) herein, and the following description is made based on that the motion information of the connecting shaft 152 is the rotation information (ir) generated by the rotation information generation unit 420.

The rotation information (ir) is transmitted to the comparison unit 510 in a sequential order. That is, the rotation information (ir) is transmitted from the rotation information generation unit 420 to the comparison unit 510 over time.

The previous rotation information (ir) is generated by the rotation information generation unit 420 and transmitted to the comparison unit 510 earlier than the current rotation information (ir).

The comparison unit 510 compares the previous rotation information (ir) with the current rotation information (ir), and transmits it to the change information generation unit 520.

Here, the comparison unit 510 determines if the previous rotation information (ir) is the same as the current rotation information (ir), and when they are not the same, the change information generation unit 520 generates the current rotation information (ir) as the change information (is).

The comparison unit 510 determines if the previous rotation information (ir) is the same as the current rotation information (ir) by comparing the previous rotation information (ir) and the current rotation information (ir) received in a sequential order.

In this instance, when as a result of the comparison, the previous rotation information (ir) is determined to be the same as the current rotation information (ir), the change information generation unit 520 does not generate the change information (is).

On the contrary, when as a result of the comparison, the previous rotation information (ir) is not determined to be the same as the current rotation information (ir), the change information generation unit 520 generates the current rotation information (ir) as the change information (is).

As a result, when the connecting shaft 152 remains motionless, the change information (is) is not generated, and when the connecting shaft 152 moves, the change information (is) is generated.

Subsequently, the control module 600 receives the change information (is) generated by the comparison module 500 and controls the storage location of the change information (is).

The control module 600 receives the change information (is) generated by the comparison module 500, and controls the storage location of the change information (is).

The control module 600 receives the change information (is) generated by the change information generation unit 520 of the comparison module 500, and determines the storage location of the change information (is).

Here, the smart deadlock system includes a memory module 700 to store the change information (is) received from the control module 600; a communication module 800 to transmit the change information (is) received from the control module 600; and a mobile terminal 10 including a storage unit 11 to store the change information (is), and a transmission unit 12 to transmit a driving command (io), and which performs near-field communication with a communication unit.

The memory module 700 may be configured in the deadlock to store the change information (is) received from the control module 600.

The communication module 800 may transmit the change information (is) received from the control module 600 to the external mobile terminal 10 as described below.

The mobile terminal 10 includes the storage unit 11 to store the change information (is) and the transmission unit 12 to transmit the driving command (io), and performs near-field communication with the communication unit. The near-field communication may be based on Bluetooth or NFC.

The control module 600 performs control to store the change information (is) in the memory module 700, and when the mobile terminal 10 is connected to the communication module 800, transmits the change information (is) to the mobile terminal 10 through the communication module 800, not via the memory module 700, and stores the change information (is) in the storage unit 11.

The control module 600 determines the storage location of the change information (is). When the mobile terminal 10 is connected to the communication module 800 via near-field communication, the change information (is) is stored in the mobile terminal 10, not the memory module 700. Accordingly, when the mobile terminal 10 is not connected to the communication module 800, the change information (is) is stored in the memory module 700.

The smart deadlock system may further include a driving unit to operate the driving gear 163, and the driving unit may receive the driving command (io) of the mobile terminal 10 through the communication unit and operate the driving gear 163.

A smart deadlock system according to another embodiment of the present disclosure includes a wireless communication bridge 30 to receive the change information (is) from the communication module 800 and transmit the change information (is) to a server 20; the server 20 to store the change information (is) received from the wireless communication bridge and transmit the change information (is) to the mobile terminal 10; and a display unit 13 to receive the change information (is) from the server 20 and display the change information (is), and a transmission unit 12 to transmit a driving command (io).

Referring to FIG. 2, the change information (is) generated by the comparison module 500 is transmitted to the communication module 800 through the control module 600. The change information (is) is transmitted from the communication module 800 to the wireless communication bridge 30, and the wireless communication bridge 30 transmits the change information (is) to the server 20. The change information (is) is stored in the server 20, and the server 20 transmits the change information (is) to the mobile terminal 10. The mobile terminal 10 displays the received change information (is) on the display unit 13.

That is, the change information (is) is transmitted to the mobile terminal 10 through the communication module 800, the wireless communication bridge 30 and the server 20.

Additionally, when the mobile terminal 10 transmits the driving command (io) to the server 20, the server 20 may transmit the driving command (io) to the wireless communication bridge, the wireless communication bridge may transmit the driving command (io) to the communication unit, and the driving unit may operate the driving gear 163 in response to the driving command (io) received from the communication unit.

Hereinafter, the detailed structure of the deadlock hardware applicable to the smart deadlock system will be described with reference to FIGS. 3 and 4.

The deadlock includes an inner assembly 100 including a thumb-turn unit 150 having a thumb-turn 151 and a connecting shaft 152 extending from the thumb-turn 151 and having an insertion groove 153 at the end, the inner assembly 100 installed on the inside of the door and including an inner plate 120 including an inner substrate 130 on the inner surface and an inner cover 110 that wraps around the inner plate 120 on the outer surface; an outer assembly 200 including a key unit 240 having a key cylinder 241 at one end and a square shaft 242 extending from the other end, the outer assembly 200 installed on the outside of the door and including an outer plate 220 including an outer substrate 230 on the inner surface and an outer cover 210 that wraps the outer plate 220 on the outer surface; a driving unit 160 disposed in the inner assembly 100 to open and close the thumb-turn 151, and including a motor 161 having a driving gear 163 coupled to the connecting shaft 152 of the thumb-turn unit 150 and a transmission gear 162 engaged with the driving gear 163 to transmit the power to the driving gear 163; and a deadbolt unit 300 disposed between the inner assembly 100 and the outer assembly 200 and coupled to the connecting shaft 152 of the thumb-turn unit 150 when the square shaft 242 of the key unit 240 is coupled and connected to the insertion groove 153 of the thumb-turn unit 150, wherein the inner assembly may further include, on the side, a lock button 140 connected to the inner substrate 130 that controls the driving unit 160 to shut off the current flowing to the driving unit 160 in order to enable only manual manipulation, and the outer substrate 230 of the outer assembly may further include a communication unit to remotely control the driving unit 160 from the outside and a sensor unit to sense external situations.

The inner assembly 100 is installed on the inner side of the door, and includes the inner plate 120 including the inner substrate 130 on the inner surface and the inner cover 110 that wraps around the inner plate 120 on the outer surface, and the thumb-turn unit 150 including the thumb-turn 151 and the connecting shaft 152 extending from the thumb-turn 151 and having the insertion groove 153 at the end.

The inner assembly 100 is installed on the inner side of the door.

The door refers to a door that requires a locking mechanism, installed for entry from the outside into the inside, for example, a front door.

The inner side of the door refers to the door viewed from the inside of a space in which the door is installed.

The inner assembly 100 and the outer assembly 200 as described below are installed facing each other with respect to the door. In this instance, the inner assembly 100 is disposed on the inner side of the door corresponding to the internal space, and the outer assembly 200 is disposed on the outer side of the door corresponding to the external space.

The inner assembly 100 includes the inner plate 120 including the inner substrate 130 on the inner surface, and the inner cover 110 that wraps around the inner plate 120 on the outer surface.

The inner substrate 130 is a printed circuit board (PCB), and is connected to the driving unit 160 and the lock button 140 as described below to control the operation of the driving unit 160 and the lock button 140.

The inner plate 120 provides a space for attaching the inner substrate 130 to the inner surface.

The inner plate 120 has, at the center, a through-hole 101 in which the thumb-turn unit 150 as described below is installed, and a coupling guide to allow coupling with the outer plate 220 as described below by a fastening element.

The inner cover 110 is installed on the inner plate 120 around the outer surface of the inner plate 120.

The inner cover 110 has the same shape as the outer surface of the inner plate 120. Accordingly, the inner cover 110 has a through-hole corresponding to the through-hole 101 of the inner plate 120.

Additionally, the inner assembly 100 includes the thumb-turn unit 150.

The thumb-turn unit 150 includes the thumb-turn 151 and the connecting shaft 152 extending from the thumb-turn 151 and having the insertion groove 153 at the end.

The thumb-turn 151 is turned to close or open the deadlock inside the house, and extends toward the inside of the house and is installed in the inner assembly 100.

The connecting shaft 152 extends from the thumb-turn 151, and has the insertion groove 153 at the end.

The connecting shaft 152 is inserted into the through-hole 101 of the inner cover 110 and the inner plate 120, and the key unit 240 as described below is coupled to the insertion groove 153 at the end.

The outer assembly 200 is installed on the outer side of the door, and includes the outer plate 220 including the outer substrate 230 on the inner surface and the outer cover 210 that wraps around the outer plate 220 on the outer surface, and the key unit 240 including the key cylinder 241 at one end and the square shaft 242 extending from the other end.

The outer assembly 200 is installed on the outer side of the door.

As described above, the outer assembly 200 and the inner assembly 100 are installed facing each other with respect to the door. In this instance, the outer assembly 200 is disposed on the outer side of the door corresponding to the external space, and the inner assembly 100 is disposed on the inner side of the door corresponding to the internal space.

The outer assembly 200 includes the outer plate 220 including the outer substrate 230 on the inner surface, and the outer cover 210 that wraps around the outer plate 220 on the outer surface.

The outer substrate 230 is a PCB and includes a communication unit and a sensor unit as described below, and the communication unit transmits a signal to the driving unit 160 to operate the driving unit 160.

The outer plate 220 provides a space for attaching the outer substrate 230 to the inner surface.

The outer plate 220 has, at the center, a hole 201 in which the key unit 240 as described below is installed, and a coupling guide to allow coupling with the inner plate 120 by a fastening element.

The outer cover 210 is installed on the outer plate 220 around the outer surface of the outer plate 220.

The outer cover 210 has the same shape as the outer surface of the outer plate 220. Accordingly, the outer cover 210 has a hole corresponding to the hole 201 of the outer plate 220.

Additionally, the outer assembly 200 includes the key unit 240.

The key unit 240 includes the key cylinder 241 at one end and the square shaft 242 extending from the other end.

The key cylinder 241, into which the key is inserted to close or open the deadlock from the outside of the house, is installed in the outer assembly 200.

The square shaft 242 extends from the key cylinder 241, and is coupled to the insertion groove 153 formed at the end of the connecting shaft 152.

When the square shaft 242 and the connecting shaft 152 are coupled to each other, the thumb-turn unit 150 and the key unit 240 are connected to each other to put the deadbolt unit 300 as described below into operation.

The driving unit 160 is disposed in the inner assembly 100, and includes the motor 161 having the driving gear 163 coupled to the connecting shaft 152 of the thumb-turn unit 150 and the transmission gear 162 engaged with the driving gear 163 to transmit the power to the driving gear 163, and opens and closes the thumb-turn 151.

The driving unit 160 is disposed in the inner assembly 100. The driving unit 160 is fixed to the inner plate 120 of the inner assembly 100 with a fastening element.

The driving unit 160 includes the motor 161 having the driving gear 163 coupled to the connecting shaft 152 of the thumb-turn unit 150 and the transmission gear 162 engaged with the driving gear 163 to transmit the power to the driving gear 163.

The transmission gear 162 is installed in the motor 161, and the transmission gear 162 is engaged with the driving gear 163 to transmit the power from the motor 161 to the driving gear 163.

The deadbolt unit 300 is disposed between the inner assembly 100 and the outer assembly 200, and when the square shaft 242 of the key unit 240 and the insertion groove 153 of the thumb-turn unit 150 are coupled and connected to each other, the deadbolt unit 300 is coupled to the connecting shaft 152 of the thumb-turn unit 150.

The deadbolt unit 300 is disposed between the inner assembly 100 and the outer assembly 200.

The deadbolt unit 300 includes a deadbolt and a deadlatch 310 having a hub 320.

The deadbolt 330 protrudes and is locked, and the hub 320 brings the deadbolt 330 into operation by rotation.

When the square shaft 242 of the key unit 240 and the insertion groove 153 of the thumb-turn unit 150 are coupled and connected to each other, the hub 320 is coupled to the connecting shaft 152 of the thumb-turn unit 150.

That is, the square shaft 242 of the key unit 240 is coupled to the insertion groove 153 of the thumb-turn unit 150, and the connecting shaft 152 of the thumb-turn unit 150 is coupled to the hub 320 of the deadlatch 310. Then, the deadlatch 310 operates, and the deadbolt 330 operates.

When the key cylinder 241 of the key unit 240 is operated using the key from the outside or the thumb-turn 151 of the thumb-turn unit 150 is operated from the inside, the deadbolt 330 is extended by rotation of the hub 320 of the deadbolt unit 300, thereby manually locking or unlocking the deadlock.

It is commonly known that the deadbolt 330 is designed to operate by the hub 320 of the deadlatch 310, and a further detailed description is omitted herein.

The lock button 140 is disposed on the side of the inner assembly 100, and is connected to the inner substrate 130 that controls the driving unit 160 to shut off the current flowing to the driving unit 160 in order to enable only manual manipulation.

The lock button 140 is installed on the side of the inner assembly 100. To this end, the inner cover 110 of the inner assembly 100 and the side of the inner plate 120 have a hole in which the lock button 140 is inserted and installed.

The lock button 140 is connected to the inner substrate 130 that controls the driving unit 160. In detail, the inner substrate 130 has a button for shutting off the current flowing to the driving unit 160, and when the lock button 140 presses the button, the driving unit 160 stops the operation.

Using the lock button 140, the deadlock may be locked or unlocked by only manual manipulation. Accordingly, when a user presses the lock button 140 in the house, the deadlock may be only opened by the key (outside) or the thumb-turn 151 (inside).

The outer substrate 230 of the outer assembly further includes a communication unit to remotely control the driving unit 160 from the outside, and a sensor unit to sense external situations.

The communication unit receives a signal from the mobile terminal based on a radio frequency (RF) card, a remote control and Bluetooth. The signal is transmitted to the inner substrate 130 of the inner assembly 100 and operates the deadbolt unit 300 through the motor 161 of the driving unit 160 to lock or unlock the door.

The sensor unit may include a communication history storage unit, a camera and a vibration/fire sensor of the mobile terminal. Through this, it is possible to manage access history, identify visitors and cope with intrusion or fires.

The deadlock of the present disclosure may use both manual opening/closing by the key cylinder 241 through manipulation of the thumb-turn 151 or the key, and automatic opening/closing by the driving unit 160 through the communication unit or the sensor unit using the mobile terminal.

Accordingly, the user may selectively manipulate the deadlock according to the usage environment.

Meanwhile, the rotation sensing plate 164 may be inserted onto the connecting shaft 152 and provided adjacent to the driving gear 163 as shown in FIGS. 7 and 8.

Meanwhile, when the rotation sensing element 900 is the driving gear 163 as shown in FIGS. 5 and 6, the sensor module 400 may include the generation unit 411 and the receiving unit 412 disposed on one side and the other side of the driving gear 163 respectively.

Additionally, when the rotation sensing element 900 is the rotation sensing plate 164 as shown in FIGS. 7 and 8, the sensor module 400 may include the generation unit 411 and the receiving unit 412 disposed on one side and the other side of the rotation sensing plate 164 respectively.

The embodiments of the present disclosure have been hereinabove described by way of illustration, and it is obvious to those skilled in the art that a variety of modifications and equivalents may be made thereto. Therefore, it will be clearly understood that the present disclosure is not limited to the embodiments mentioned above in the detailed description. Accordingly, the true technical protection scope of the present disclosure should be defined by the technical spirit of the appended claims. It should be further understood that the present disclosure includes all modifications, equivalents and substitutions within the spirit and scope of the present disclosure defined by the appended claims.

What is claimed is:

1. A smart deadlock system, comprising:

a thumb-turn;

a key cylinder;

a connecting shaft connecting the thumb-turn and the key cylinder; and a sensor module comprising:

a sensing unit to sense a rotation state of a rotation sensing element inserted onto the connecting shaft, and generate sensing information associated with the rotation state of the rotation sensing element; and a rotation information generation unit to receive the sensing information from the sensing unit, and generate rotation information associated with an extent of rotation of the rotation sensing element based on the sensing information.

2. The smart deadlock system according to claim 1, wherein the sensing unit comprises:

a generation unit disposed on one side of the rotation sensing element to generate a predetermined light source toward the rotation sensing element; and a receiving unit disposed on an other side of the rotation sensing element to receive the light source passing through the rotation sensing element.

3. The smart deadlock system according to claim 1, wherein the rotation sensing element is a driving gear having a plurality of teeth extending along an outer periphery, the teeth spaced apart at a predetermined interval.

4. The smart deadlock system according to claim 1, wherein the rotation sensing element is a rotation sensing plate having a plurality of light source passage holes along an outer peripheral direction, the light source passage holes spaced apart at a predetermined interval.

5. A smart deadlock system, comprising:

a thumb-turn;

a key cylinder;

a connecting shaft connecting the thumb-turn and the key cylinder; and a sensor module to sense a motion of the connecting shaft, the smart deadlock system comprising:

a comparison module including a comparison unit to receive motion information of the connecting shaft from the sensor module in a sequential order and compare previous motion information with current motion information, and a change information generation unit to generate change information of the motion information; and a control module to receive the change information generated by the comparison module and control a storage location of the change information.

6. The smart deadlock system according to claim 5, further comprising:

a memory module to store the change information received from the control module;

a communication module to transmit the change information received from the control module; and a mobile terminal including a storage unit to store the change information and a transmission unit to transmit a driving command, the mobile terminal performing near-field communication with the communication module.

7. The smart deadlock system according to claim 6, wherein the control module is configured to perform control to store the change information in the memory module, and when the mobile terminal is connected to the communication module, the change information is transmitted to the mobile terminal through the communication module, not via the memory module, and stored in the storage unit.

8. The smart deadlock system according to claim 6, further comprising:

a wireless communication bridge to receive the change information from the communication module and transmit the change information to a server;

the server to store the change information received from the wireless communication bridge and transmit the change information to the mobile terminal; and the mobile terminal including a display unit to receive the change information from the server and display the change information, and the transmission unit to transmit the driving command.

9. The smart deadlock system according to claim 5, wherein the comparison unit determines if the previous motion information is the same as the current motion information; and when the previous motion information is not the same as the current motion information, the change information generation unit generates the current motion information as the change information.

* * * * *